United States Patent [19]

Wittpenn, Jr. et al.

[11] Patent Number: 4,814,109

[45] Date of Patent: Mar. 21, 1989

[54] METHOD OF CLEANING CONTACT LENSES

[76] Inventors: John R. Wittpenn, Jr., 4 Old Field La., Mt. Sinai, N.Y. 11766; Richard L. Giovanoni, 220 Richmond St., East Taunton, Mass. 02718

[21] Appl. No.: 155,553

[22] Filed: Feb. 12, 1988

Related U.S. Application Data

[63] Continuation-in-part of Ser. No. 34,043, Apr. 3, 1987.

[51] Int. Cl.[4] ..... C11D 1/83

[52] U.S. Cl. ..... 252/547; 252/106; 252/173; 252/174.21; 252/557; 252/559; 252/DIG. 5; 252/DIG. 14

[58] Field of Search ..... 252/538, 528, 544, 547, 252/557, 559, 174.21, DIG. 5, DIG. 13, DIG. 14, 173, 106

[56] References Cited

U.S. PATENT DOCUMENTS 4,013,576 3/1977 Loshaek ..... 252/547
4,152,283 5/1979 Cordrey et al. ..... 252/546
4,560,491 12/1985 Sherman ..... 252/174.24
4,622,258 11/1986 Mencke ..... 428/290
4,734,222 3/1988 Winterton et al. ..... 252/174.21

*Primary Examiner*—A. Lionel Clingman
*Assistant Examiner*—Hoa Van Le
*Attorney, Agent, or Firm*—Watson, Cole, Grindle & Watson

[57] ABSTRACT

The method of cleansing a contact lens adapted to be worn in close proximity to the cornea of the eye and typically having a light coating of mucus, lipids, or other proteinaceous materials on its outer surface, which comprises placing a drop of a mild, nonirritating surfactant composition on the lens while it is being worn to remove said coating from the outer surface thereof, said composition comprising:

(a) an anionic surfactant;
(b) a nonionic surfactant; and
(c) an amine oxide surfactant in an amount capable of enhancing the foaming properties of the anionic and nonionic surfactants while further reducing the irritating characteristics of the anionic surfactant.

4 Claims, No Drawings

METHOD OF CLEANING CONTACT LENSES

This application is a continuation-in-part of our copending application Ser. No. 034,043, filed Apr. 3, 1987, and entitled Surfactant Compositions.

BACKGROUND OF THE INVENTION

The present invention relates generally to the use of surfactant compositions to clean contact lenses. More particularly, it relates to the use of a surfactant composition which is composed of a combination of surfactants that make it an effective cleansing agent, but with non-irritating properties such that it lacks significant irritating characteristics when in contact with periocular and ocular surface tissues.

As disclosed in our copending application Ser. No. 034,043, filed Apr. 3, 1987, for some time a desirable surfactant product has been sought in which the advantageous foaming properties of an anionic surfactant can be maintained while avoiding the irritation to the skin that such surfactants normally cause. The characteristic of irritating sensitive human skin and membranes is particularly evident when the surfactant is to be utilized in the vicinity of the human eye. Such surfactants or shampoos have previously been utilized to help in the control of oily debris, cosmetics and encrusted material that may form on the scalp and face. Yet there is definite need for a surfactant composition for use in conditions requiring good eyelid and eyelash cleansing.

An example of one such condition is acute and chronic blepharitis. Blepharitis is an inflammation of the eyelids that arises in the glands found at the base of the eyelashes (glands of Zeis and Moll) and just behind the eyelashes (meibomian glands). These glands secrete an oily lipid material (meibom), which is essential for maintenance of the normal tear film on the ocular surface as well as the natural lubrication of the eyelids. When these glands become inflamed or clogged by thickened secretions, cosmetics, infection, or other causes not yet identified, the surrounding tissues become inflamed. The resulting inflammation of the eyelids and ocular surface is called blepharitis and can produce a variety of symptoms of ocular dysfunction. These symptoms may include but not be limited to any or all of the following: irritation, itching, burning, dryness, tearing, redness of the eyelids and conjunctiva, filmy vision, chalazion or hordeolum formation, and loss of eyelashes. Severe cases can even produce corneal opacification and decreased vision.

The mainstay of present therapy for blepharitis is the combined use of warm compresses and daily lid hygiene to clean the oily secretions, crusting and other forms of debris which accumulate on the eyelids and eyelashes, thereby exacerbating the inflammatory problem. Certain oral and topical medications are then added to this primary therapy as needed in each individual case. However, at present there is no cleansing surfactant product specifically designed for use by the patient to clean the eyelids and eyelashes. Therefore eye care professionals currently recommend the use of mineral oil or mild hair shampoos. These shampoos must be diluted by the patient with water to reduce the irritancy of the cleansing component in the shampoo. Despite using dilute hair shampoos, many patients develop a secondary ocular irritation from the cleansing agents, themselves. These shampoos have the additional disadvantage of containing dyes and/or perfumes which do not enhance the cleansing potential but may act as ocular irritants.

It has now been found that the surfactant that is the subject of our copending application is especially adapted for use in removing mucus, lipids or other proteinaceous materials from the surface of a contact lens, either by immersing the contact lens in the surfactant solution, or by applying said surfactant solution to the contact lens while it is in place on the eye of the wearer. It is, therefore, a primary object of the present invention to provide a process or method of using the surfactant composition that maintains the foaming and cleansing characteristics of an anionic surfactant, while at the same time significantly ameliorating the irritating characteristcs of such anionics, as a contact lens cleaner. This surfactant composition is specifically suitable for such use.

These and other objects of the present invention will become more apparent to one of skill in this art from the summary and detailed description of the invention provided hereinafter.

SUMMARY OF THE INVENTION

Our invention is, in its broad form, a method of cleansing contact lenses adapted to be worn in close proximity to the cornea of the eye by the use of a non-irritating surfactant composition having good foaming characteristics. The composition comprises an anionic surfactant with high foaming properties and only mildly irritating to human tissues; non-ionic surfactants capable of reducing the irritant properties of the anionic surfactant and also of emulsifying and solubilizing physiologic debris, such as mucus and an induced non-ionic surfactant which enhances the foaming properties of the anionic and non-ionic surfactants while further reducing the irritating characteristics of the anionic surfactant.

The induced non-ionic surfactant, as we use that term herein, may take the form of an amine oxide, e.g., coco amido propyl oxide or lauryldimethyl amine oxide or may take the form of an alkanolamide such as Witcamide STD-HP manufactured by Witco Chemical Corp. of New York. The anionic surfactant as used in the surfactant composition of the present invention may be a sulfosuccinate, e.g., disodium laureth sulfosuccinate.

In one form of our invention, the nonionic surfactant is a blend of two nonionic surfactants which, with respect to each other, have relatively high and low melting points. Exemplarily, these melting points may be at about 40° to 44° C. for the low melting point composition and 50° to 54° C. for the high melting point composition. In this way the use of two or more nonionic surfactants can be used to balance the viscosity of the resulting composition. Generally, the two compositions will be used together so that they will be present in combination, in an amount somewhat greater than the amount of anionic detergent utilized. The surfactant composition of the present invention will advantageously utilize other materials that will, for example, provide antimicrobial protection.

While our invention broadly contemplates the application of the surfactant in aqueous solution to the lens by any convenient method, it is conceived that the solution will serve as a dip in which the lens will be immersed for a period of time sufficient to remove a substantial quantity of the mucus, lipids or other proteinaceous materials adhered to the lens after it has been used, e.g., by an overnight soak. However, the surfactant composition can also be applied as an eyedrop while the lens is in place on the cornea of the wearer. Further, the method can generally be utilized for all types of contact lenses, i.e., hard, silicone, silicone matrix and water-based lenses.

DETAILED DESCRIPTION OF THE INVENTION

The composition of the present invention comprises an anionic surfactant. While there are a wide variety of anionic surfactants suitable for use in the present invention in a satisfactory manner, the surfactant selected for the best mode is one that has the greatest degree of mildness in contact with ocular or other sensitive tissues, yet supplies copious foaming, preferably in the form of microbubbles. Such a high foaming characteristic with a low degree of irritating properties has been achieved by sulfosuccinates, and most specifically by disodium laureth sulfosuccinate, a synonym for which is disodium lauryl alchol polyglycol ester sulfosuccinate. It is marketed by Sherex Co., of Dublin, Ohio, under the trademark VARSULF SBFA-30 or by sulfate and sulfonates of ethoxylated alkyl phenols such as Alipal marketed by GAF Corp. of Wayne, N.J. According to the producer's literature, the composition has been evaluated for primary eye irritation in rabbits. 15% and 10% solutions were rated moderately irritating, while a 5% solution was given a mild irritancy rating.

In the preferred embodiment of our surfactant composition, a plurality of nonionic surfactants are utilized. The purpose of using such plurality of nonionic surfactants is to do so in a ratio that will permit an adjustment of the vicosity of the resulting composition in water to meet the specific use required. The requirement of the nonionic surfactants is that they be capable of reducing the irritating properties of the anionic surfactant, and also be capable of emulsifying and solubilizing physiologic debris from the surface of the body, particularly oily secretions and collaretts, which are crusted deposits that can form around the eyelash base.

So far as the composition is concerned, we prefer to utilize both a relatively low melting point and a relatively high melting point nonionic surfactant. Surfactants that have been found to be well suited for use in the present composition are a series of nonionic, anti-irritant surfactants which generally are ethoxylated mono and diglycerides derived from coconut oil and tallow or a series of nonionic, anti-irritant surfactants which generally are alkanolamides such as coco monoethanol amide marketed as Carsamide CMEA by Lonza, Inc. of Fair Lawn, N.J. and/or lauric mono-isopropanolamide marketed as Cyclomide LIPA by Cyclo Chemical Corp. of Miami, Fla. Such nonionic surfactants are non-toxic and nonirritating to the skin or eye at the 100% active level and in aqueous dispersions. Further, they impart anti-irritating properties to anionic surfactants, including sulfosuccinates. Moreover, although the non-ionics are only moderate foamers by themselves, they do not depress the foam of high foaming anionic. By utilizing both relatively low and relatively high melting point nonionics, the viscosity of the finished system can be controlled without the use of thickeners that are themselves potentially irritating. Further, the nonionic surfactants should be good emulsifiers and solubilizers for cosmetic creams and lotions where low irritation properties, emollient and viscosity control characteristics are highly desirable.

In a preferred embodiment of our composition, we utilize a combination of two nonionics, one of which is an ethoxylated glyceryl monococoate, as the relatively low melting point nonionic, and ethoxylated glyceryl monotallowate as the relatively high melting point nonionic. The melting point of the monococoate is about 42° C.; that of the monotallowate is about 53° C. When used in predetermiend proportions, the combination of these two nonionic surfactants with the remaining ingredients in an aqueous solution may be manipulated so as to achieve desired viscosity, in addition to the other desirable properties of the nonionics. These nonionic surfactants are sold, respectively, other the trademarks VARONIC LI-67, which has the relatively low melting point, and VARONIC LI-420, which has the relatively high melting point.

The third ingredient of the composition that forms the basis of our surfactant invention is what we term: an induced nonionic surfactant is an amine oxide, which is an effective foam stabilizer for anionic surfactants, particularly for fatty alcohol sulfates, alcohol ether sulfates and alpha olefin sulfonates. These amine oxides are noted for their mildness and ease of handling. In neutral or slightly alkaline systems amine oxides behave in the manner of nonionics surfactants; hence the designation, induced nonionic surfactant. In slightly acid systems, they assume mild cationic characteristics, although they remain compatible with anionic surfactants.

By stablizing the foam of the anionic, the induced nonionic enables the cleansing action of the anionic to continue throughout the scrubbing period. Moreover, it aids in assisting a rinse-off of suds of the anionic at the end of the scrubbing period. Further, the induced nonionic at a pH for the entire composition of approximately 7 exhibits the properties of a nonionic surfactant, thereby enhancing the foaming properties of the product and acting to reduce potential irritancy of the anionic. Further, since the induced nonionic has a change in viscosity building effect in accordance with the pH of the final product—such viscosity increases as the pH of the product decreases—a final adjustment of pH at or about neutrality can serve to increase or decrease the viscosity of the final product according to the specific end use to which it is put. Thus, where a somewhat gelatinous material is desired for application, e.g., to cleansing pads, the viscosity of the present composition can be increased by adjusting to the pH to somewhat below 7, whereas in a solution to be applied on or near the ocular surface, the pH might be maintained at or slightly above 7.

The most preferred induced nonionic surfactant for use in the present composition is an amine oxide. In the best mode of that composition, we utilize cocoamido propylamine oxide. Such a composition is presently sold by Sherex Co. under the trademark VAROX 1770. This specific amine oxide is substantially non-irritating, and since the entire composition is intended to be substantially non-irritating to sensitive tissues, an amine oxide should be selected which has a very low level of irritancy.

Other materials that form part of that best mode are commercially available. Thus, disodium edetate, or ethylene diamine tetracetic acid disodium salt, functions as an anti-microbial agent and also as a pH adjuster. It acts to reduce the pH of the composition to about 7.0 to 7.2 from a range of about 7.5 to 7.8. Disodium edetate is a commonly used preservative in ophthalmic preparation intended for installation directly into the eye. Using disodium edetate to adjust pH obviates the need for adding other agents that have obviously irritating properties, e.g., hydrochloric acid or sodium hydroxide, for that purpose.

Benzyl alcohol is also preferably utilized in the surfactant composition. It functions to enhance the antimicrobial action of the disodium edetate, and has its own such action enhanced by the edetate. Benzyl alcohol is especially effective in killing or inhibiting the growth of fungi. Of course, all the ingredients of the subject composition have an inate ability to kill and/or inhibit microbial growth, either by the destruction of cell walls, as in the case of surfactants, or by directly inhibiting metabolic functions of the microbes, as with disodium edetate and benzyl alcohol.

Regarding the quantities utilized of the various materials that are part of the present formulation, to some degree the amount utilized will depend on the desired viscosity of the final composition and the pH thereof. It has, however, in the best mode been found to be most desirable to use quantities so that of the various ingredients will be present in the following amounts by weights: anionic—3%; low melting point nonionic —1%; high melting point nonionic—4%; induced nonionic —2%; disodium edetate—0.05%; benzyl alcohol—0.5%; and water for injection—the remaining 89.45%.

While these various quantities of ingredients are most preferred, the various proportions of ingredients can vary. Thus, the ratio of anionic to total nonionic (excluding induced nonionic), can vary from about 1:1 to 1:4, with the preferred ratio being about 3.5 or 1:1.67. With regard to amounts of relatively low to relatively high melting point nonionics, the range can be from 1:1 to 1:8, with 1:4 being preferred. The ratio of anionic to induced nonionic will vary advantageously between about 1:0.1 to 1:4, with 1:0.67 presently preferred. Quantities of disodium edetate and benzyl alcohol are, as indicated, preferred in quantities of about 0.05 and 0.5%, respectively, of the final solution, which in the most preferred form includes slightly less than 90% water. Also, the range of pH is about 6.7 to 7.5 more preferably 7.0 plus or minus 0.2.

The present process utilized to manufacture the product that is the subject of the best mode embodiment hereof, is to heat all four surfactants in a suitable vessel until they are liquified, being careful not to exceed a temperature greatly above that of the relatively high melting point nonionic which, in the preferred form of monotallowate, has a melting point of about 53° C. In another vessel about 85% of the formula amount of water for injection, which is either deionized, membrane filtered or distilled, is heated to the same temperature as the surfactant phase. One phase is then added to the other with rapid mixing, and after the turbidity clears, the solution is allowed to cool to room temperature with constant, slow mixing. The pH of the solution at this stage of manufacture was found to be about 7.8. Then disodium edetate is added and slow mixing continued until the edetate had totally dissolved and the pH was approximately 7.0. Finally, the benzyl alcohol is added and mixing continued until the solution cleared. Thereafter, the remaining water to bring the total weight to 100%, which in this case would be the final 4.5% water, is added.

After the composition had been produced, it underwent a series of tests to determine whether it was suitable for application to human tissues. Primary eye irritation testing was made, and no irritation was noted during the standard 28-day testing period. In skin maximization allergy testing, no irritation was noted during the standard 35-day testing period. Microbial limits testing was performed to ensure that no pathogens were present, and preservative challenge testing was performed to ensure that the composition in solution met USP requirements as a solution that can inhibit and/or kill microbes upon repeated exposure to the solution.

As formulated, a solution according to the present invention has the ability to cleanse contact lenses that are encrusted with mucus, lipids or other proteinaceous materials, either duing the typical overnight soak or when used as an eyedrop. After soaking, it is preferred to rinse the lens with fresh water prior to reinserting the lens into the eye. We have shown that contact lenses of the three principal types: hard, gas-permeable (both soft and rigid), and soft (hydrophilic) are all subject to being cleaned by our surfactant composition without substantial injury to the lens.

It will be apparent to those of skill in this art that certain alterations and modifications of the present processes as disclosed hereinbefore may be made. As to all such obvious alterations and modifications, we desire that they be included within the purview and spirit of our invention, which is to limited only by the scope, including equivalents, of the following, appended claims.

What is claimed is:

1. The method of cleansing a contact lens adapted to be worn in close proximity to the cornea of the eye and typically having a light coating of mucus, lipids, or other proteinaceous materials on its outer surface, which comprises placing a drop of a mild, nonirritating surfactant composition on the lens while it is being worn to remove said coating from the outer surface thereof, said composition comprising:

(a) an anionic surfactant having high foaming properties and being only mildly irritating to human tissues, said anionic surfactant being present in an amount sufficient to remove a substantial quantity of said materials;

(b) a nonionic surfactant in an amount capable of reducing the irritating properties of said anionic surfactant and of emulsifying or solubilizing bodily surface physiologic debris, and in addition to said anionic and nonionic surfactants, (c) an amine oxide surfactant in an amount capable of enhancing the foaming properties of the anionic and nonionic surfactants while further reducing the irritating characteristics of the anionic surfactant.

2. The method of cleansing a contact lens as recited in claim 1, in which the ratio of said anionic to said nonionic surfactant varies from about 1:1 to 1:4.

3. The method of cleansing a contact lens as claimed in claim 1, in which the ratio of said anionic to said amine oxide surfactant varies from about 1:0.1 to 1:4.

4. The method of cleansing a contact lens as claimed in claim 1, in which the ratio of said anionic to said nonionic surfactant varies from about 1:1 to 1:4 and the ratio of said anionic to said amine oxide surfactant varies from about 1:0.1 to 1:4.

* * * * *